United States Patent [19]

Emery

[11] 4,195,743

[45] Apr. 1, 1980

[54] PACKING TRAY

[76] Inventor: Roy W. Emery, 1 Donino Ct., Toronto, Ontario, Canada

[21] Appl. No.: 49,233

[22] Filed: Jun. 18, 1979

[51] Int. Cl.[2] ..... B65D 21/02; B65D 81/16

[52] U.S. Cl. ..... 217/265; 206/511; 229/2.5 R

[58] Field of Search ..... 217/26.5; 229/2.5 R; 206/507, 509, 511, 512

[56] References Cited

U.S. PATENT DOCUMENTS

| | | | |
|---|---|---|---|
| 2,378,627 | 6/1945 | Grant | 217/26.5 |
| 2,885,136 | 5/1959 | Grant | 217/26.5 |
| 3,997,057 | 12/1976 | Craig | 206/507 |
| 4,101,049 | 7/1978 | Wallace | 206/511 |

FOREIGN PATENT DOCUMENTS

| | | | |
|---|---|---|---|
| 1070565 | 6/1967 | United Kingdom | 217/26.5 |

*Primary Examiner*—George E. Lowrance

*Attorney, Agent, or Firm*—Fetherstonhaugh & Co.

[57] ABSTRACT

The invention relates to a molded tray for packing fruit and like delicate articles. The tray has pockets and posts, the pockets and posts alternating in a plurality of rows that extend longitudinally of the tray and a plurality of rows that extend transversely of the tray whereby each post merges into four pockets except in the case of those posts which are on a row on an outside edge of a tray whereby upon stacking the pockets will rest on the top of a post of an underlying tray and the posts support the pockets of an overlying tray in use. The invention is an improvement in such a tray that comprises the provision of protuberances on the side wall of each pocket the lower extremities of which extend below the surface of their respective pocket. The protuberances are spaced apart a distance slightly greater than the width of the top of one of the posts and the bottom of the protuberances is adapted to extend below the edge of a post when the trays are stacked to stabilize the trays against lateral displacement.

4 Claims, 3 Drawing Figures

PACKING TRAY

This invention relates to the configuration of trays molded from materials such as wood pulp or plastics and designed for the packaging of product that is subject to damage by bruising such as fresh apples, peaches and the like. More particularly it relates to a tray structure especially designed to achieve strength in the tray and stability of the tray with respect to other trays when stacked.

Trays of the type to which this invention relates generally comprise pocket and post formations, the pockets and posts alternating in a plurality of rows that extend longitudinally of the tray and a plurality of rows that extend transversely of the tray so that when stacked the pockets will rest on the top of a post of an underlying tray and the posts support the pockets of an overlying tray. These trays are often stacked to a substantial height and lateral stability of the tray is an important factor in their design. Another important factor in their design is the strength of the tray. It is desirable that the stacked trays should interlock against horizontal displacement and to this end prior configurations have provided for a protrusion of small diameter on the bottom of the pockets that is adapted to enter into a complementary depression on the top of an underlying post. Thus, when the trays are stacked a protrusion on the bottom of each pocket enters into an opening on the top of each post to lock the trays against horizontal displacement.

The prior art configuration does have the advantage of giving a certain amount of added stability against displacement in a horizontal direction but it is subject to the disadvantage that the article contained in the pocket bears against an opening in the bottom of the pocket that is caused by the formation of the protrusion. The article can become bruised or marked by the edge of the hole at the protrusion. The bruising is more likely to happen because of the location of the discontinuity at the bottom of the pocket where the force of the article being packed is greatest in bearing against the pocket.

This invention deals with a tray configuration that provides lateral stability for the trays when stacked but which avoids the difficulty of bruising the fruit at the bottom of the pocket. The invention avoids the formation of an interlocking discontinuity in the pocket structure on its bottom.

The invention then relates to a molded tray of the type that is designed to be vertically stacked with other similar trays and that has pockets and posts, the pockets and posts alternating in a plurality of rows that extend longitudinally of the tray and a plurality of rows that extend transversely of the tray whereby each post merges into four pockets except in the case of those posts which are on a row on an outside edge of the tray; whereby upon stacking the pockets will rest on the top of a post of an underlying tray and the posts will support the pockets of an overlying tray, and comprises the improvement of a pair of diametrically opposed outwardly extending protuberances on the side wall of each pocket, the lower extremities of said protuberances extending below the surface of their respective pocket where they join with the pocket and being spaced apart a distance slightly greater than the width of the top of the posts, the bottom of said protuberances being adapted to extend below the edge of a post when the trays are stacked to stabilize the trays against lateral displacement. The invention will be clearly understood after reference to the following detailed specification read in conjunction with the drawings:

Figure 1:
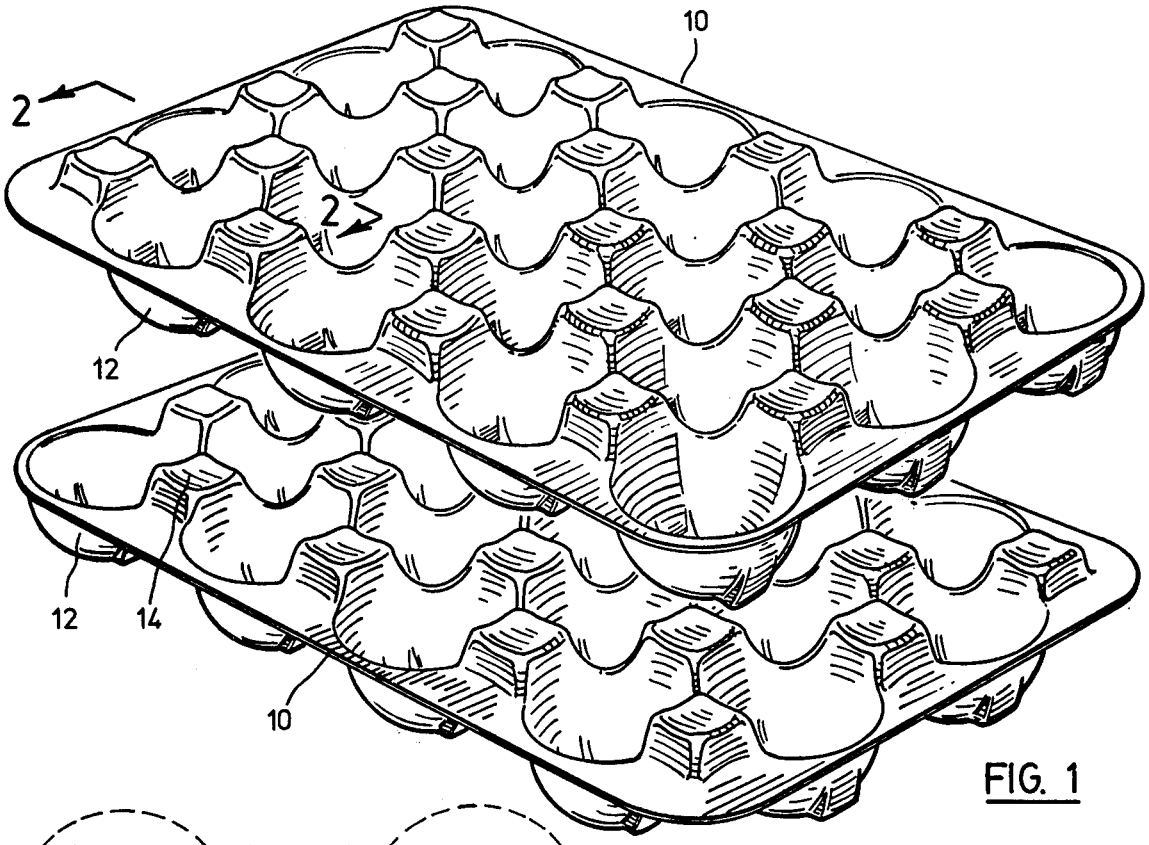
FIG. 1 is a perspective illustration of two trays according to this invention about to be stacked one upon the other.

The numerals 10 generally refer to similar packing trays. These trays are customarily molded from wood fiber although they could be molded from other materials. They have pockets 12 and posts 14 which alternate in rows. There is a plurality of rows that extend longitudinally of the tray and a plurality of rows that extend transversely of the tray. The row on the outside starts with a pocket and ends with a post. Each post merges into four pockets except in the case of those posts which are on a row on an outside edge of the tray so that upon stacking each pocket will rest on the top of a post of an underlying tray and each post will support the pocket of an overlying tray. This general arrangement of pockets and posts in these trays is very well known and has been established for many years.

This invention is concerned with an improvement in the pocket formation which is designed to give lateral stability to a series of stacked trays. In the embodiment of the invention shown there is a pair of diametrically opposed outwardly extending reinforcing ribs 16 on the side wall of each pocket 14. The lower extremities of these ribs extend below the surface of their respective pockets and are spaced apart a distance slightly greater than the width of the top of the posts so that when the trays are stacked, the lower extremities of the ribs of each pocket extend around and below the edge of the post of an underlying tray to stabilize the trays against lateral displacement. The stabilizing interlocking is illustrated as at 18 in FIG. 2 of the drawings.

Figure 2:
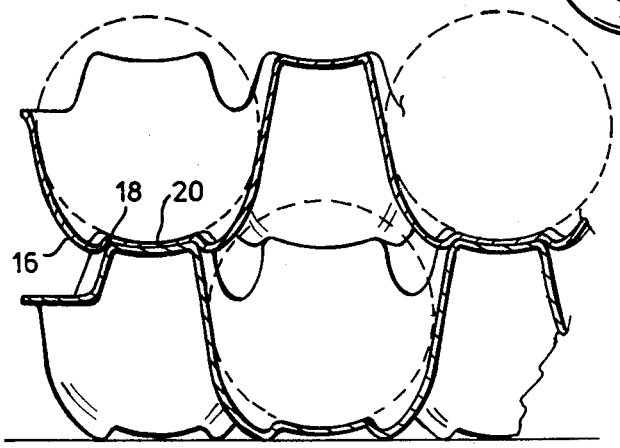
FIG. 2 is a sectional view of the two trays along the line 2—2 of FIG. 1, but showing the trays in stacked relation and also illustrating the position of a delicate article such as a peach or apple in place in pockets.
Figure 3:
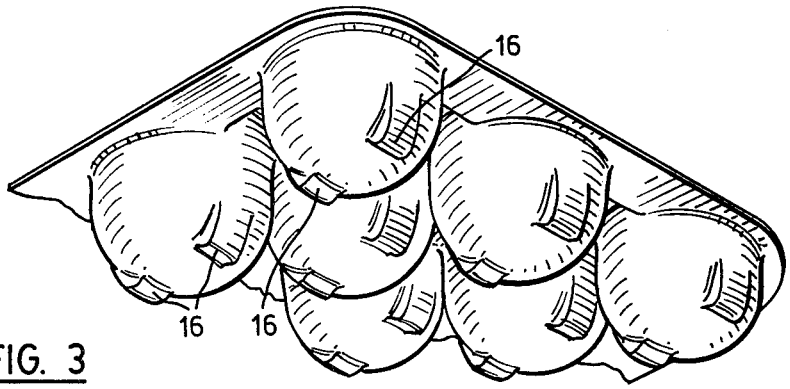
FIG. 3 is a partial perspective view of the underside of one of the trays illustrating the construction of the reinforcing ribs.

Preferably the rounded bottom of the pockets is made complementary to the top of the posts as at 20 in FIG. 2 to achieve maximum interlocking relationship against lateral displacement.

The reinforcing ribs do form a discontinuity in the side wall of the pocket against which the article being packed will rest. However, the force of an article supported in a pocket is not as great at the side wall as it is at the bottom and the likelihood of bruising of a delicate piece of fruit due to force against the depression in the pocket caused by the rib formation is not nearly as great as the danger of bruising due to a discontinuity in the pocket at its bottom.

Embodiments of the invention other than the one illustrated will be apparent to those skilled in the art. For example more than two reinforcing ribs could be provided. The configuration of the ribs is also subject to variation. It is not intended that the invention should be restricted to the embodiment illustrated.

Reinforcing ribs have been illustrated but it will be apparent that the important stabilizing function of the invention can be achieved with any pocket protuberance that extends around and below the edge of an underlying post. Protuberances other than reinforcing ribs are contemplated to be within the scope of the invention.

I claim:

1. In a molded tray of the type that is designed to be vertically stacked with other similar trays and that has pockets and posts, the pockets and posts alternating in a plurality of rows that extend longitudinally of the tray and a plurality of rows that extend transversely of the tray whereby each post merges into four pockets except in the case of those posts which are on a row on an outside edge of the tray whereby upon stacking the pockets will rest on the top of a post of an underlying tray and the posts support the pockets of an overlying tray, the improvement of a pair of diametrically opposed outwardly extending protuberances on the side wall of each pocket, the lower extremities of said protuberances extending below the surface of their respective pocket where they join with the pocket and being spaced apart a distance slightly greater than the width of the top of one of the posts, the bottom of said protuberances being adapted to extend below the edge of a post when the trays are stacked to stabilize the trays against lateral displacement.

2. In a tray of the type set forth in claim 1 the improvement claimed in claim 1 wherein the bottom of said pockets is complementary to the top of said posts.

3. In a tray of the type set forth in claim 1 the improvement claimed in claim 1 wherein the protuberances are in the form of reinforcing ribs.

4. In a tray of the type set forth in claim 1 the improvement claimed in claim 1 wherein the protuberances are in the form of reinforcing ribs and wherein the bottom of said pockets is complementary to the top of said posts.

* * * * *